US011083238B2

(12) United States Patent
Morgan

(10) Patent No.: US 11,083,238 B2
(45) Date of Patent: Aug. 10, 2021

(54) PENDULUM IMPACT DAMPING SYSTEM

(71) Applicant: Strategic Sports Limited, Kowloon (HK)

(72) Inventor: Donald Edward Morgan, Brisbane (AU)

(73) Assignee: Strategie Sports Limited, Kowloon (HK)

( * ) Notice: Subject to any disclaimer, the term of this patent is extended or adjusted under 35 U.S.C. 154(b) by 103 days.

(21) Appl. No.: 16/121,070

(22) Filed: Sep. 4, 2018

(65) Prior Publication Data

US 2018/0368504 A1 Dec. 27, 2018

Related U.S. Application Data

(62) Division of application No. 15/045,943, filed on Feb. 17, 2016, now Pat. No. 10,098,404.

(30) Foreign Application Priority Data

Feb. 19, 2015 (AU) ..... 2015900577

(51) Int. Cl.
*A42B 3/12* (2006.01)
*A42B 3/06* (2006.01)
(Continued)

(52) U.S. Cl.
CPC ..... *A42B 3/125* (2013.01); *A42B 3/064* (2013.01); *A42B 3/08* (2013.01); *A42B 3/283* (2013.01)

(58) Field of Classification Search
CPC ..... A42B 3/125; A42B 3/08; A42B 3/283; A42B 3/085; A42B 3/06; A42B 3/128;
(Continued)

(56) References Cited

U.S. PATENT DOCUMENTS 3,153,242 A * 10/1964 Nedwick ..... A42B 3/064 2/411
4,345,338 A * 8/1982 Frieder, Jr. ..... A42C 2/007 2/414

(Continued)

FOREIGN PATENT DOCUMENTS

KR 20-0413824 Y1 4/2006
KR 10-1392144 B1 5/2014
WO WO 2010-001230 A1 1/2010

OTHER PUBLICATIONS

Motorcycle and Bicycle Protective Helmets: Requirements Resulting from a Post Crash study and Experimental Research, J.P. Corner et al., 1987, Report No. CR 55, Federal Office of Road Safety, Canberra.

(Continued)

*Primary Examiner* — Nathan E Durham
*Assistant Examiner* — Abby M Spatz
(74) *Attorney, Agent, or Firm* — Gordon & Jacobson, P.C.

(57) ABSTRACT

A helmet comprised of a hard outer shell, a compressible liner in contact with an inner surface of the hard outer shell, and a comfort liner in contact with an inner surface of the compressible liner. The damping hole is defined longitudinally along a longitudinal axis through the hard outer shell, the compressible liner, and the comfort liner. The helmet also includes a pendulum damping system disposed in the damping hole and extending longitudinally from the outer shell to the comfort liner. The pendulum damping system has a pendulum mass that is laterally displaceable within the damping hole.

13 Claims, 9 Drawing Sheets

(51) Int. Cl.
*A42B 3/08* (2006.01)
*A42B 3/28* (2006.01)

(58) Field of Classification Search
CPC ..... A42B 3/063; A42B 3/121; A42B 3/122; A42B 3/124; A42B 3/127; A42B 3/064; A63B 71/10
USPC ..... 2/411, 412, 414, 425
See application file for complete search history.

(56) References Cited

U.S. PATENT DOCUMENTS 5,774,901 A 7/1998 Minami
5,794,272 A 8/1998 Workman et al.
6,425,142 B2 7/2002 Sasaki et al.
8,060,951 B2 11/2011 Smith
8,640,267 B1 * 2/2014 Cohen ..... A42B 3/063 2/411
8,756,719 B2 6/2014 Veazie
2001/0032351 A1 * 10/2001 Nakayama ..... A42B 3/12 2/412
2004/0250340 A1 * 12/2004 Piper ..... A42B 3/064 2/411
2005/0257312 A1 * 11/2005 Puchalski ..... A42B 3/324 2/411
2006/0070170 A1 * 4/2006 Copeland ..... A63B 71/10 2/411
2006/0075693 A1 * 4/2006 Tsunoda ..... B31D 3/0207 52/80.1
2007/0000032 A1 * 1/2007 Morgan ..... A42B 3/124 2/412
2010/0000009 A1 * 1/2010 Morgan ..... F41H 1/08 2/414
2010/0115686 A1 * 5/2010 Halldin ..... A42B 3/064 2/422
2010/0186150 A1 * 7/2010 Ferrara ..... F16F 9/0481 2/412
2010/0264571 A1 * 10/2010 Tarazona De La Asuncion ..... A42B 3/128 267/141
2011/0252544 A1 * 10/2011 Abernethy ..... A42B 3/122 2/413
2012/0060251 A1 * 3/2012 Schimpf ..... A42B 3/064 2/5
2012/0180201 A1 * 7/2012 Cripton ..... A42B 3/0473 2/411
2012/0198604 A1 * 8/2012 Weber ..... A42B 3/125 2/414
2013/0000015 A1 * 1/2013 Marzec ..... A42B 3/12 2/411
2013/0042397 A1 * 2/2013 Halldin ..... A42B 3/145 2/411
2013/0232668 A1 * 9/2013 Suddaby ..... A42B 3/125 2/413
2013/0247284 A1 * 9/2013 Hoshizaki ..... A42B 3/12 2/413
2014/0033402 A1 * 2/2014 Donnadieu ..... A42C 2/002 2/413
2014/0173810 A1 * 6/2014 Suddaby ..... A42B 3/064 2/413
2015/0089722 A1 * 4/2015 Berry ..... A42B 3/064 2/412
2015/0143617 A1 * 5/2015 Suddaby ..... A42B 3/064 2/414
2015/0157083 A1 * 6/2015 Lowe ..... A42B 3/064 2/412
2015/0305427 A1 * 10/2015 Prabhu ..... A42B 3/128 2/412
2015/0359285 A1 * 12/2015 Rennaker, II ..... A42B 3/064 2/414
2016/0040743 A1 * 2/2016 Staton ..... F41C 23/06 2/412
2016/0242484 A1 8/2016 Morgan
2018/0056168 A1 * 3/2018 Sodec, Jr. ..... A63B 71/10
2018/0132557 A1 * 5/2018 Torres ..... A42B 3/205
2018/0255862 A1 * 9/2018 Ho ..... A42B 3/12

OTHER PUBLICATIONS

The Influence of Reduced Friction on Head Injury Metrics in Helmeted Head Impacts, John D. Finan et al., 2008, Traffic Injury Prevention, 9:5, 483-488, DOI: 10.1080/15389580802272427.
Head Protection Devices, Bertil Aldman, 1984, The Biomechanics of Impact Trauma, Elsevier Science Publishers B.V., pp. 413-416.
Pathophysiology. In Traumatic Brain Injury, A.L. Halliday, 1999, ed. D.W. Marion, 29-31. New York: Thieme.
Research and Innovation; POC Sports; archived on Dec. 4, 2013 at https://web.archive.org/web/20131204023915/http://www.pocsports.com/en/content/view/protective-concepts.
Introducing MIPS Technology; Bell Helmets; archived on Dec. 17, 2014 at https://web.archive.org/web/20141217134604/http://www.bellhelmets.com/mips.
6D, Advanced Impact Defense; Omni-Directional Suspension, archived on Dec. 19, 2014 at https://web.archive.org/web/20141219001632/http://www.6dhelmets.com/#!ods/c10b6.
Lazer Helmets; Innovation and Technology; SuperSkin; archived on Apr. 11, 2012 at https://web.archive.org/web/20120411071621/http://www.lazerhelmets.com/innovations/superskin/.
Leatt Unveils Helmet Prototypes; Jun. 19, 2014; http://leatt-corp.com/press-releases/leatt-unveils-helmet-prototypes/.
Motoweek; Leatt Corporation, GPX helmet; http://idnmotoweek.blogspot.com/2014_11_30_archive.html; Friday Dec. 5, 2014.

* cited by examiner

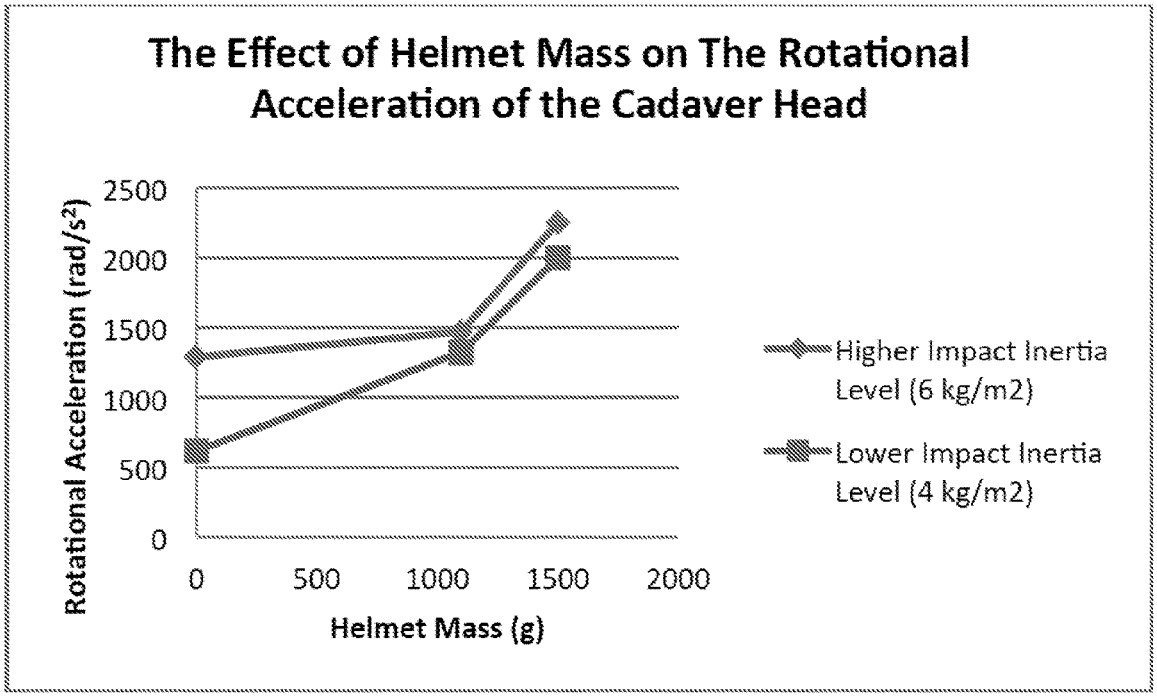
FIG. 5
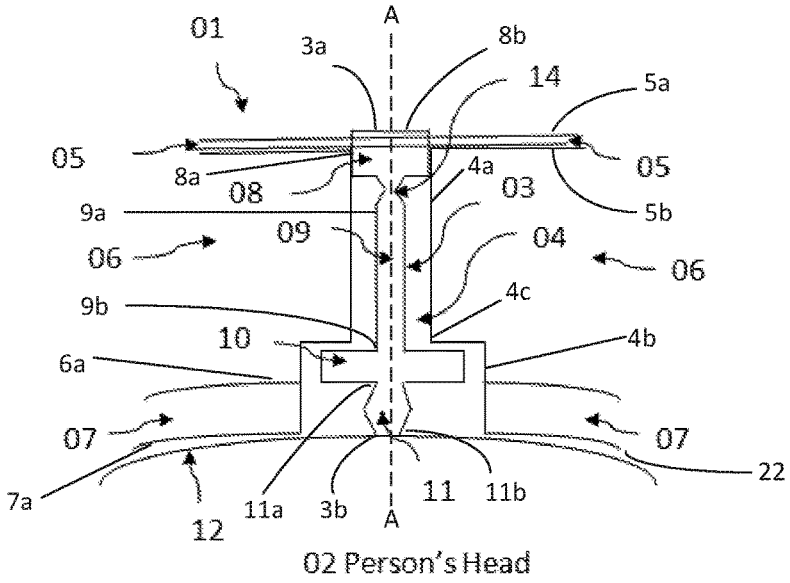
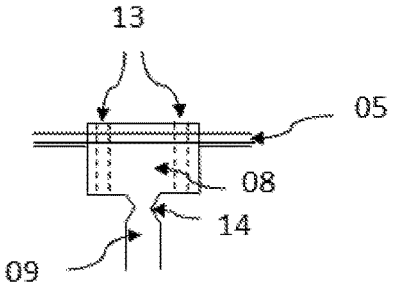
Fig. 6b
FIG. 6a

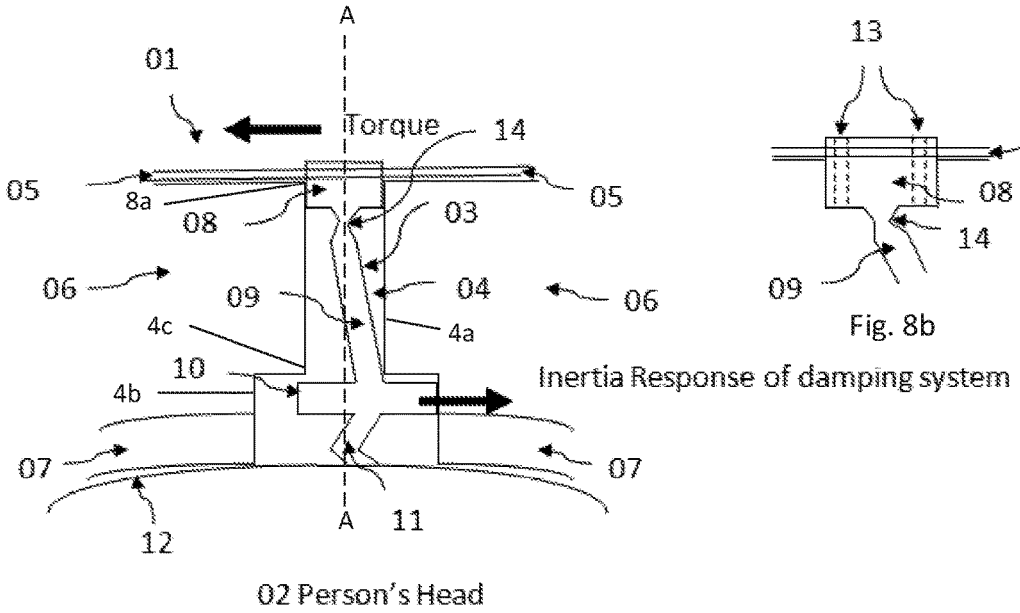
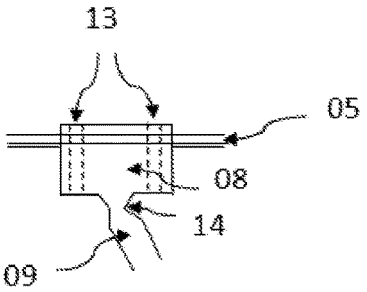
Fig. 8b
FIG. 8a
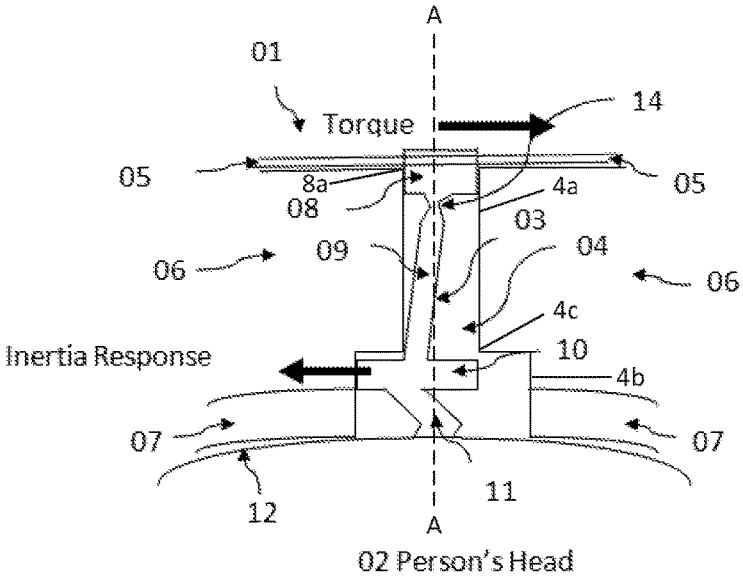
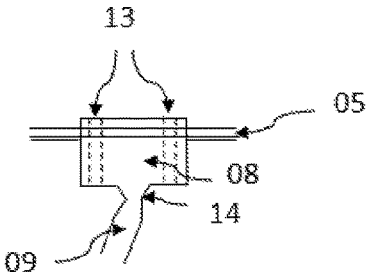
FIG. 9b
FIG. 9a

PENDULUM IMPACT DAMPING SYSTEM

CROSS REFERENCE TO RELATED APPLICATIONS

This application is a divisional of U.S. application Ser. No. 15/045,943, filed Feb. 17, 2016, which claims priority under 35 U.S.C. § 119 to Australian Provisional Patent Application AU 2015900577, filed Feb. 19, 2015, the entire contents of all of which are incorporated by reference herein.

BACKGROUND

1. Field

The present invention relates to impact protection, and more specifically, to impact protection for the head.

2. State of the Art

An impact to a moving head can cause the head to rapidly decelerate, while inertia keeps the brain travelling forward to impact the inside surface of the skull. Such impact of the brain against the skull may cause bruising (contusions) and/or bleeding (hemorrhage) to the brain. Therefore, deceleration of the head is an important factor to consider in determining the severity of brain injuries caused by impact to the head.

In all types of impacts to the head, the head is subjected to a combination of linear acceleration and rotational acceleration. Linear acceleration is considered to contribute to focal brain injuries, while rotational acceleration is considered to contribute to both focal and diffuse brain injuries.

Helmets may be used to protect the head from impacts. However, all helmets add at least some added mass to the head of its wearer. As discussed in greater detail below, adding mass to a helmet can increase the rotational acceleration and deceleration effects to the head and brain as compared to a helmet of a smaller mass.

Various impact protection technologies exist that have been proposed for use in helmets to address linear and/or rotational acceleration. Such technologies include Omni Directional Suspension™ (ODS™), Multiple Impact Protection System (MIPS®), SuperSkin®, and 360° Turbine Technology.

In a helmet with Omni Directional Suspension™ (ODS™) the outer shell and the liner are separated by ODS™ components. However, the ODS™ components add mass and bulk to the helmet. Also, the ODS™ components include hard components adhered to the inside of the outer shell. As a result, the ODS™ system requires the use of a hard and stiff liner to accommodate the hard components. Moreover, there is a possibility of individual ODS™ components detaching due to wear and tear.

In a helmet that incorporates the MIPS®, the helmet includes an outer shell, an inner liner, and a low friction layer. The low friction layer is located on the inside of the foam liner against the head, such that the shock absorbing foam liner is not in direct contact with the head. However, the use of the friction layer and its attachments reduces the ability of the helmet to effectively absorb an impact force. Moreover, MIPS® technology adds mass and bulk to the helmet.

In a helmet with SuperSkin®, a layer of a membrane and lubricant is applied to the outer shell of the helmet. The layer reduces friction between the outer shell and the impacting surface thereby reducing angular (rotational) effects on the head and brain.

In a helmet with 360° Turbine Technology multiple circular turbines are located on the inside of the foam liner against the head. While the technology adds minimal mass to the helmet, portions of the turbines may dislodge from wear and tear and, therefore, may not provide protection to the wearer of the helmet during an impact.

With the exception of SuperSkin® Technology, the above-mentioned helmet technologies do not take into account the whole thickness and mass of the helmet as a factor in limiting deceleration. Also, the above-mentioned helmet technologies encourage the incorporation of harder and stiffer liners (expanded polystyrene foam and other foams). However, harder and stiffer liners may be detrimental to a helmet's effectiveness to absorb translational and angular impact forces.

SUMMARY

A pendulum damping system is described that improves helmets by reducing angular acceleration and deceleration effects to the head and brain without compromising the ability of the helmet to absorb translational or angular forces for high and low impacts. The present disclosure relates to all helmets for improved protection against rotational and angular acceleration and deceleration effects to the head.

According to one embodiment, a pendulum damping system is provided within the thickness of a helmet for glancing oblique impact protection to reduce angular acceleration and deceleration effects to the brain of a wearer of the helmet.

The pendulum damping system responds to torque that is applied externally to the outer shell surface of the helmet as well as within the interior of the helmet. During a glancing oblique impact, the damping system responds immediately to torque when first applied to the outer shell of the helmet instead of waiting for the propagation of the torque into the helmet. In contradistinction, existing systems respond only to torque that is applied internally to the helmet and in a delayed fashion.

According to one embodiment, a helmet is comprised of a hard outer shell, a compressible liner in contact with an inner surface of the hard outer shell, and a comfort liner in contact with an inner surface of the compressible liner. The damping hole is defined longitudinally along a longitudinal axis through the hard outer shell, the compressible liner, and the comfort liner. The helmet also includes a pendulum damping system disposed in the damping hole and extending longitudinally from the outer shell to the comfort liner. The pendulum damping system has a pendulum mass that is laterally displaceable within the damping hole.

The pendulum damping system may include an outer anchor attached to the hard outer shell, a rod flexibly coupled to the outer anchor and extending longitudinally inwardly to the pendulum mass to which the rod is coupled, and a head stabilizer flexibly coupled to the pendulum mass and spaced longitudinally and inwardly from the pendulum mass. The head stabilizer is configured to directly engage a head of a wearer of the helmet and, thus, couple the pendulum mass to the head of the wearer. The pendulum damping system may also include a resilient member extending between the pendulum mass and the head stabilizer. In response to a torque applied externally to the outer shell during an impact, the pendulum mass oscillates laterally and/or longitudinally in the damping hole to facilitate dissipation of energy of the impact.

According to another embodiment, a helmet includes a hard outer shell, a compressible liner in contact with an inner surface of the hard outer shell, and a comfort liner in contact with an inner surface of the compressible liner. A damping hole is defined longitudinally along a longitudinal axis through the hard outer shell, the compressible liner, and the comfort liner. Also, the helmet includes a pendulum damping system disposed in the damping hole and extending longitudinally from the outer shell to the comfort liner. The damping system includes an outer compressible disc attached to the outer shell, a rod coupled to the outer disc and extending longitudinally inwardly to an inner compressible disc to which the rod is coupled, the inner compressible disc attached to the compressible liner, and a head stabilizer flexibly coupled to the inner compressible disc and spaced longitudinally and inwardly from the inner compressible disc. The head stabilizer is configured to engage a head of a wearer of the helmet. The rod may be rigid or compressible.

BRIEF DESCRIPTION OF THE DRAWINGS

FIG. 5 is a graph that shows the effect of added mass to a cadaver head and the effects on the rotational acceleration of the cadaver for two levels of impact inertia.

FIG. 6*a* is a schematic cross-sectional view of one embodiment of a pendulum impact damping system in accordance with the present disclosure.

FIG. 6*b* is an exploded schematic cross-section of a top portion of the pendulum impact damping system shown in FIG. 6*a*.

FIG. 8*a* is a schematic cross-sectional view of the pendulum impact damping system of FIG. 6*a* showing its response during a first stage (acceleration "spin up") caused by a glancing oblique impact.

FIG. 8*b* is an exploded schematic cross-section of a top portion of the pendulum impact damping system of FIG. 8*a*.

FIG. 9*a* is a schematic cross-sectional view of the pendulum impact damping system of FIG. 8*a* showing its response during a second stage (acceleration "spin down") following the first stage.

FIG. 9*b* is an exploded schematic cross-section of a top portion of the pendulum impact damping system of FIG. 9*a*.

DETAILED DESCRIPTION

Impact types may be classified as impacts involving a translational (linear) force and impacts involving a rotational force, which may occur together in an impact or separately. For impacts involving a pure translational force, the helmeted head of the rider undergoes rapid acceleration or deceleration movement in a straight line without rotating about the brain's center of gravity, which is located in the pineal region of the brain. For impacts involving a pure rotational force, the helmeted head undergoes rapid rotational acceleration or deceleration about the brain's center of gravity.

Figure 4:
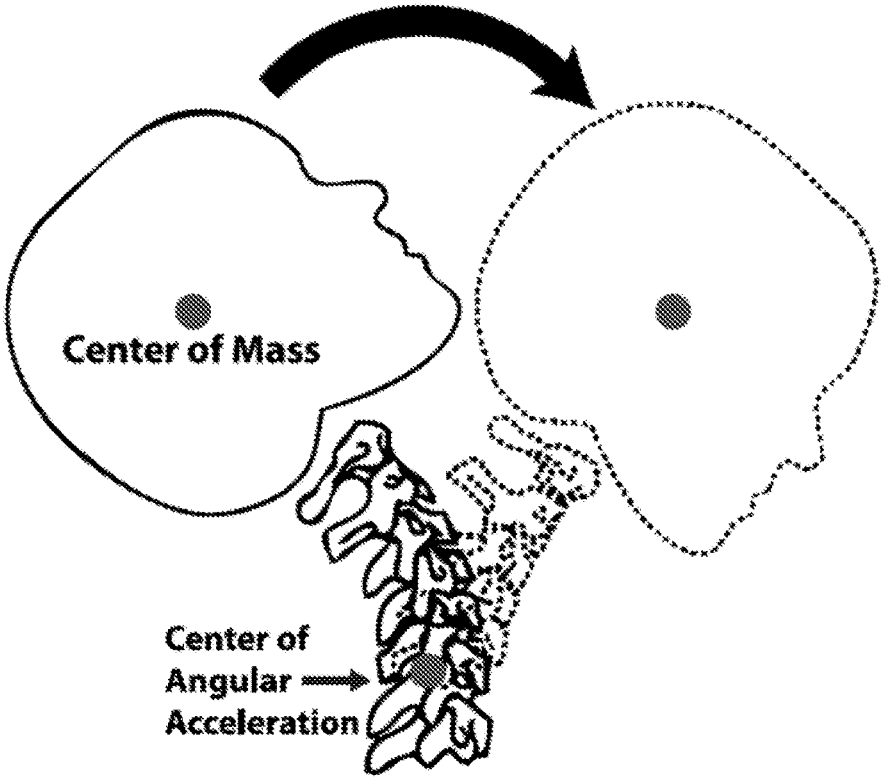
FIG. 4 shows a center of angular acceleration and deceleration of the head in the helmet of FIG. 2.

FIG. 4 shows the center of angular acceleration (and deceleration) located at about the sixth cervical vertebrae in the lower cervical spine. For impacts involving purely angular acceleration, the brain's center of gravity will rapidly bend forward, backwards, or sideways about the center of angulation. For impacts involving the center of angular acceleration located higher in the cervical spine or at the base of the skull, the head will exert greater rotational acceleration and deceleration effects on the brain. The greater the degree of rotational acceleration experienced by the helmeted head will result in greater shearing injuries sustained by the brain, as will be discussed in greater detail below. The magnitude and duration of time of the angular acceleration and deceleration will determine the seriousness of the brain injury sustained, as will be discussed in greater detail below.

Figure 1:
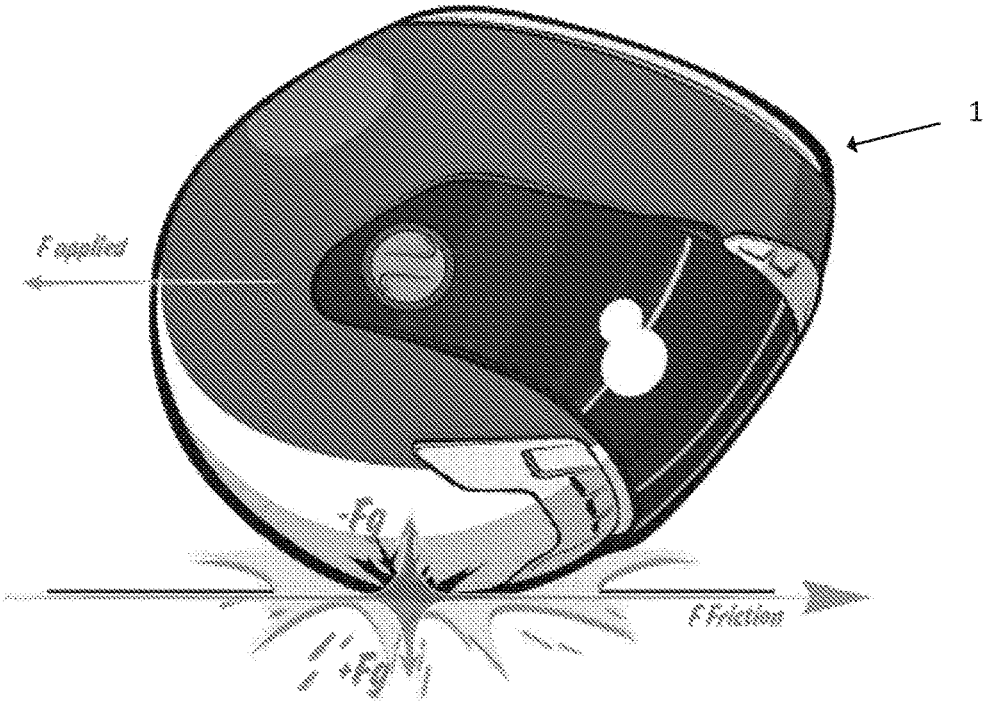
FIG. 1 illustrates forces involved in an impact between a helmet worn by a user and the ground.

Many impacts involve a combination of translational and rotational forces. The forces involved in an impact are shown in FIG. 1. These include: the downward force $+F_g$ due to gravity which is the weight of the helmeted head (plus body); the upward force $-F_g$ due to the impacting surface acting on the helmeted head, which is the reaction force (This is Newton's 3rd Law of motion: for every action there will be an equal and opposite reaction); the horizontal applied force $F_{applied}$, which is the translational component of the combined force acting on the helmeted head of the rider and is always acting forward; and the horizontal frictional force $F_{friction}$ due to the road surface acting on the outer shell of the helmet which is always acting opposite to the applied horizontal force.

Figure 2:
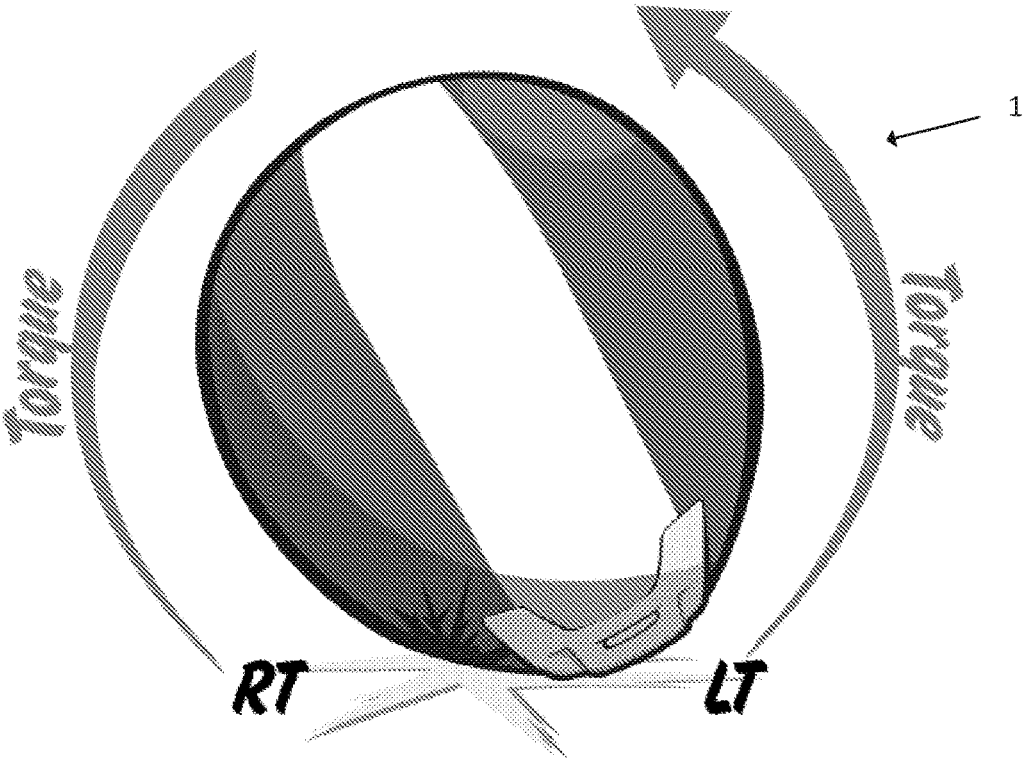
FIG. 2 illustrates graphically the torque applied to the helmet as a result of a glancing oblique impact.

By referring to FIG. 2, a glancing oblique impact shown on the right side of the helmet, above the visor, results in the rider's head (and body) experiencing a severe twisting force, which is the rotational component of the combined force, acting about a point of rotation. The friction created between the outer shell of the helmet and the road surface creates a momentary gripping effect on the helmet, resulting in the rider's helmeted head experiencing a torque causing deceleration or acceleration effects on the brain. Many traumatic head injuries (e.g., that motorcyclists and cyclists sustain)

are caused by rotational forces that are commonly generated as a result of the helmeted head experiencing such a glancing oblique impact with a hard road surface or another immovable object.

Figure 3:
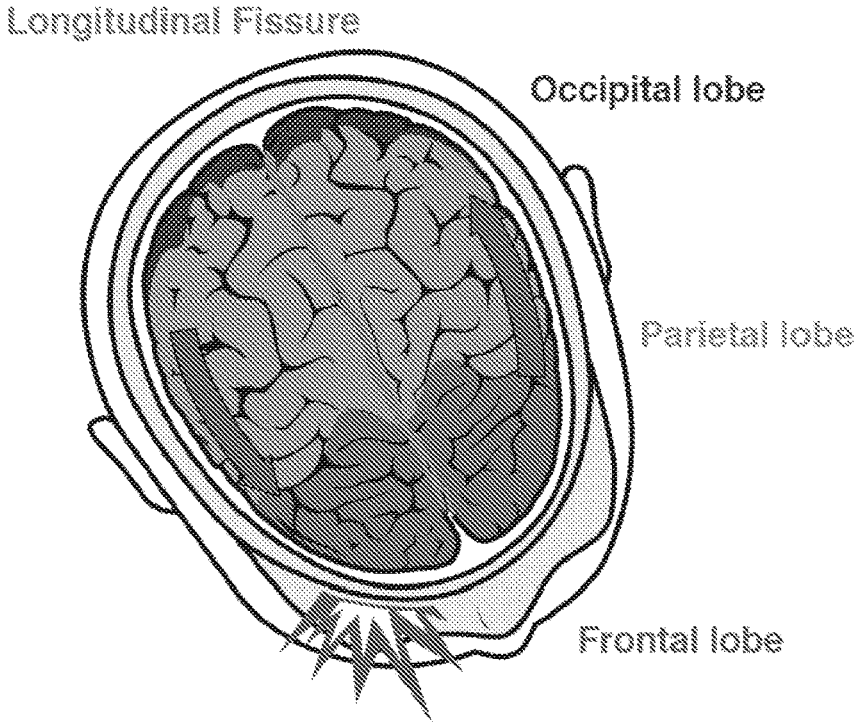
FIG. 3 illustrates schematically a section view of the brain of a wearer of the helmet of FIG. 2 during the glancing oblique impact.

FIG. 3 shows a schematic view of a brain of a wearer of the helmet of FIG. 2 with a top of the skull removed for clarity of illustration. The brain is a jelly-like, soft tissue suspended within the skull in a bath of cerebral spinal fluid. The brain is covered by three membrane layers in which the outer-most layer, called the dura-mater, is connected to the inside of the skull at various suture points which serve to suspend the brain within the skull. Rapid rotational acceleration or deceleration result in shearing forces affecting the various suture points and different masses of the brain, thereby causing stretching and tearing of nerve axon fibers and rupturing of bridging veins. It has been reported that two tolerance limits for rotational acceleration are 1,800 rad/$s^2$ for concussion and 5,000 rad/$s^2$ for bridging vein ruptures. The shearing forces occur markedly at junctions between brain tissues of different densities. For example, gray matter has a greater density than white matter, resulting in portions of the brain moving at different rates inside the skull. For example, the inner part of the brain will lag behind the outer part of the brain. The brain tissues may be damaged if they are subjected to acceleration or deceleration beyond their respective tolerance limits.

Moreover, the magnitude and duration time of the angular acceleration and deceleration are factors that can affect the severity of the brain injury sustained. In general, the longer the time for the application of the striking force to the helmet, the less work the helmet will have to do to absorb that force. This is based on the following impulse equation:

$$F \times t = m \times \Delta v, \quad (1)$$

where F represents the impact force, t represents the time for the application of the force (time of impact interaction), m represents the mass of the helmet, and Δv represents a change in velocity. In other words, the helmet does work in absorbing the impact force over the time of impact interaction.

Some foam helmets are made of single-density hard foam (e.g., similar to the foam used in bicycle helmets). Such a hard foam helmet, when subject to an impact, will experience a short impact time and a large deceleration of the head, requiring the helmet to do a relatively large amount of work in absorbing the impact force. Hard foam helmets generally cannot absorb the impact force and do little to reduce the force translated through the helmet to the head.

Also, some helmets include compressible foam materials to provide for a gradual deceleration owing to compression of the foam. The compression of such materials may reduce the deceleration of the head, so that the impact time of interaction is longer. As a result of the longer impact time, there is a reduction (in comparison with a head impact where a helmet is worn with a hard foam liner) in the forces translated through the helmet to the head.

As noted above, rotational acceleration of the brain does not occur alone in the majority of impacts. However, the interactions between the head and neck favor the production of angular acceleration upon impact. When there is a combination of translational and rotational acceleration, angular acceleration is the most common form of inertial injury of the head. FIG. 4 shows the center of angular acceleration (and deceleration) located at about the sixth cervical vertebrae in the lower cervical spine. For impacts involving angular acceleration, the brain's center of gravity will rapidly bend forward, backwards, or sideways about the center of angulation on the neck. For impacts involving the center of angular acceleration located higher in the cervical spine or at the base of the skull, the head will exert greater rotational acceleration and deceleration effects on the brain.

The greater the mass of the helmet 1 on the rider's head, the greater the rotational acceleration or deceleration effects will be on the brain. FIG. 5 shows the effects of added mass to a cadaver head and the effects on the rotational acceleration of the cadaver for two levels of impact inertia. The average human head weighs about 1.5 kilograms. As shown in FIG. 5, the effect on rotational acceleration of the added mass of a helmet increases slowly up to 1,000 grams, but then the effect increases at a greater rate above 1,000 grams. Also, the effect on rotational acceleration of the added mass of a helmet is more pronounced for lower impact inertia levels than it is for higher impact inertia levels. Therefore, minimizing the added amount of mass to a helmet is beneficial to reducing the rotational acceleration and deceleration effects on the brain.

FIGS. 6*a* and 6*b* show schematic cross-sectional views of a helmet 1 that is configured to be worn on a head 2 of a wearer and that incorporates an embodiment of one or more pendulum impact dampers 3. Reference is first made to FIG. 6*a*, which shows a cross-section of the pendulum impact damper 3, that is positioned at least partially inside a circular damping hole 4 that is defined through the thickness of the helmet 1. In one embodiment, the hole 4 extends longitudinally about a longitudinal axis A-A from the outside of the helmet 1 to the inside of the helmet 1. In FIG. 6*a* the pendulum damper 3 is shown in a neutral, undeformed position, extending substantially parallel to axis A-A. The damper 3 extends from an outer end 3*a* to an inner end 3*b*.

As used herein, the terms "inner", "inward", and "inwardly" refer to directions from outside of the helmet towards the head 2 of the wearer and the terms "outer", "outward", and "outwardly" refer to directions from inside of the helmet towards the outside of the helmet away from the head 2 of the wearer. Also, as used herein, the terms longitudinal and lateral, refer, respectively, to directions parallel to the axis A-A of the damping hole 4 and transverse to the axis of the damping hole.

The helmet 1 may also include a hard outer shell 5 and a shock absorbing liner 6, which extends against an inner contact surface of the outer shell 5. The shock absorbing liner 6 may be made of foam, such as expanded polystyrene foam (EPS), for example. Alternatively the shock absorbing liner 6 may be made of a viscoelastic material. The outer end 3*a* of the damper 3 is attached to the outer shell 5. The damper 3 may be employed with any desired helmet including motorcycle, bicycle, skiing, skating, football, horse riding as well as helmets used by construction workers, emergency workers, and military personnel.

The helmet 1 also includes a comfort liner 7 that extends against an inner contact surface 6*a* of the shock absorbing liner 6. The comfort liner may be made from cushioning foam, similar to upholstery padding. An inner side of the comfort liner 7 is spaced from a head stabilizer 12, which is attached to the inner end 3*b* of the damper 3.

The damping hole 4 is defined by a first longitudinally extending portion 4*a* and a second longitudinally extending portion 4*b*, which are coaxially aligned about axis A-A. In the embodiment shown in FIG. 6*a* the two portions 4*a*, 4*b* have different diameters; i.e., the second portion 4*b* has a larger diameter than that of the first portion 4*a*. In one embodiment, the first portion 4*a* extends inwardly from the outer side of the hard outer shell 5 to a transition point 4*c* located within the shock absorbing liner 6. In another embodiment, the damping hole 4 may not extend through the hard outer shell 5. The transition point 4*c* is a point where the diameters of the two portions 4*a*, 4*b* of the damping hole 4 vary. The second portion 4*b* extends from the transition point 4*c* to an inner side 7*a* of the comfort liner 7.

The damper 3 may be conceptually divided into sections as follows: 1) an outer anchor 8; an outer neck 14; a shaft 9; a pendulum mass 10; a resilient member 11; and a head stabilizer 12.

The outer anchor 8 may be attached (e.g., adhered, fused, bonded, etc.) to the outer shell 5 of the helmet 1 and/or the shock absorbing liner 6. In the embodiment shown in FIG. 6*a* a lateral surface 8*a* of the outer anchor 8 may be attached to a complementary contact surface of the first portion 4*a* of the bore 4 within the outer thickness of the shock absorbing liner 6. In one embodiment, the outer end 8*b* of the anchor 8 may be flush with or protrude from an outer surface 5*a* of the hard shell 5. Alternatively, in a case where the hole 4 does not extend through the hard outer shell 5, the outer end of the anchor may be in contact with an inner surface 5*b* of the hard outer shell 5.

The flexible neck 14 extends inwardly from the outer anchor 8. The flexible neck 14 may include at least one narrowing or tapered portion, and may be formed substantially in the shape of an hourglass, as shown in FIG. 6*a*. The outer neck 14 is also connected to an outer end 9*a* of the shaft 9. The shaft 9 and the flexible neck 14 are spaced from and have no contact with the inner surface of the hole 4. The neck 14 provides a resilient, flexible connection between the shaft 9 and the outer anchor 8 to permit the shaft 9 to pivot about the neck 14 so that the shaft 9 can deflect at an angle with respect to the longitudinal axis A-A in at least one configuration, as will be described in greater detail below. In the neutral, undeformed position shown in FIG. 6*a*, the shaft 9 hangs loosely from the flexible neck 14, parallel to axis A-A, inside the circular damping hole 4. Also, in the neutral position shown in FIG. 6*a*, the outer anchor 8, the neck 14, and the shaft 9 extend coaxially along the longitudinal axis A-A.

An inner end 9*b* of the shaft 9 is connected to the pendulum mass 10. In the embodiment shown in FIG. 6*a*, the pendulum mass 10 has a diameter that is greater than that of the anchor 8 and the shaft 9, but is less than that of the second portion 4*b* of the damping hole 4. Thus, in the neutral position shown in FIG. 6*a* the pendulum mass 10 is spaced laterally from and hangs loosely inside the second portion 4*b* of the damping hole 4, just inward of the transition point 4*c*.

The pendulum mass 10 is connected to an outer end 11*a* of the resilient member 11. The connection between the pendulum mass 10 and the resilient member 11 is flexible and resilient. The resilient member 11 is extendable, compressible, and pivotable about the longitudinal axis A-A to permit movement of the pendulum mass 10 longitudinally and laterally within the second portion 4*b* of the hole 4. The resilient member 11 is configured to elastically deform in one or more of shear, rotational slip, as well as in compression when the damper 3 is deflected from its neutral position, such as when the pendulum mass 10 moves laterally relative to axis A-A during an impact event, as described in greater detail below. The resilient member 11 may deflect at an angle with respect to the longitudinal axis A-A, as will be described in greater detail herein below and return to its undeflected position shown in FIG. 6*a*. The resilient member 11 may be solid or may be tubular and hollow on its inside to promote longitudinal compression.

An inner end 11*b* of the resilient member 11 is connected to the head stabilizer 12. The connection between the head stabilizer 12 and the resilient member 11 is flexible and resilient so as to allow the resilient member 11 to deflect laterally at an angle with respect to the head stabilizer 12 as well as to extend and compress longitudinally with respect to the head stabilizer 12. An inner surface of the head stabilizer 12 is configured to contact or otherwise engage the head 2 at or near a predetermined position on the head 2, such as the crown of the head. The head stabilizer 12 can enhance the cushioning effect of the comfort liner 7 as well as add stability for holding the head 2 inside the helmet 1. A gap 22 is defined between the head stabilizer 12 and the inner surface 7*a* of the comfort liner 7. The gap 22 permits access for airflow into and out of the hole 4. Due to relative movement between the helmet 1 and the head 2 during use, the gap 22 may change in size or even close temporarily.

FIG. 6*b* shows an exploded view of an upper portion of FIG. 6*a*. As shown in FIG. 6*b*, the outer anchor 8 may define two air vents 13. The air vents 13 may be formed as cylindrical through holes extending longitudinally through the outer anchor 8. The air vents 13 may align with holes formed in outer shell 5. The air vents 13 are used to convey air between the exterior of the helmet 1 and the interior of the helmet 1. In that regard, the air vents 13 are in communication with the gap 22 so that air may flow through the hole 4 between the air vents 13 and the gap 22.

In one embodiment a diameter of the first portion 4*a* of the damping hole 4 may be 10 mm to 30 mm, and a diameter of the second portion 4*b* of the damping hole 4 may be 20 mm to 40 mm. Also, the lateral distance between the cylindrical shaft 9 and the first portion of the damping hole 4 may be 2 mm to 10 mm, and the distance between the outer periphery of the pendulum mass 10 and the second portion of the damping hole 4 may be up to 10 mm, and more preferably may be 5 to 10 mm. In one embodiment the length of the first portion 4*a* may be 25 mm to 60 mm.

Figure 6C:
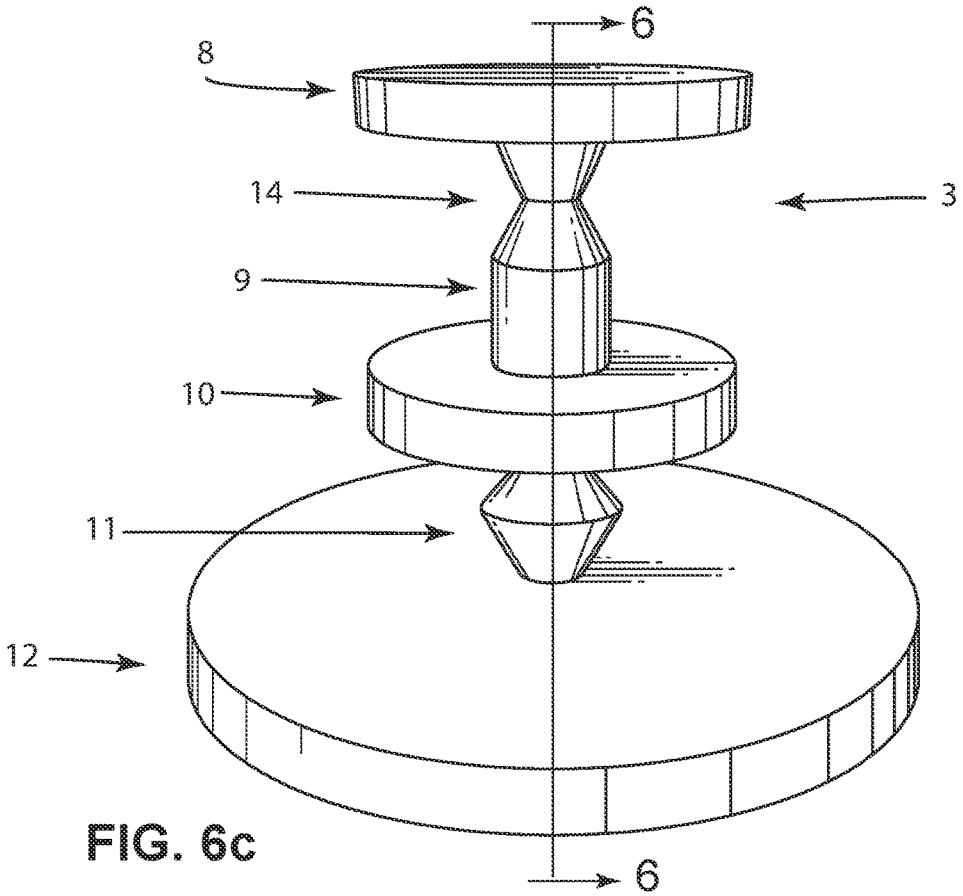
FIG. 6*c* shows an isometric view of an example of the damper of FIG. 6*a*.
Figure 6D:
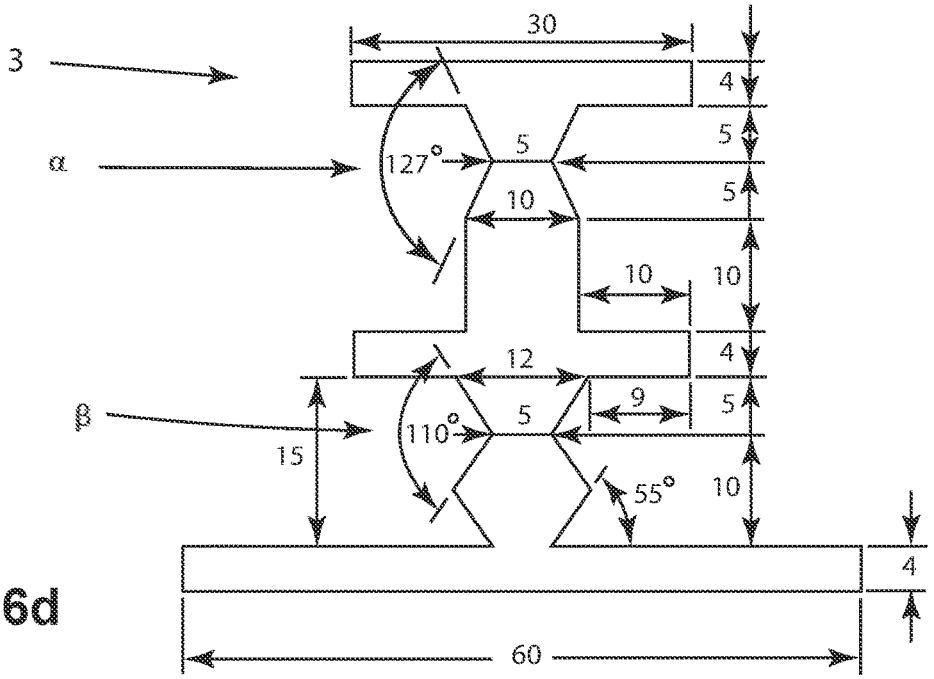
FIG. 6*d* shows a view of the damper of FIG. 6*c* along section 6-6 in FIG. 6*c*.

FIG. 6*c* shows an isometric view of an embodiment of a damper 3 and FIG. 6*d* shows a section view of the damper 3 along line 6-6 in FIG. 6*c*. In the embodiment shown, the included angle $\alpha$ between the outer surfaces of the neck 14 is about 127±10 degrees and the included angle $\beta$ between the outer surfaces of the resilient member 11 is about 110±10 degrees. Also, in FIG. 6*c*, the head stabilizer 12 has a diameter of 60 mm, the pendulum mass 10 has a diameter of 30 mm, and the cylindrical outer anchor 8 has a diameter of 30 mm. The pendulum mass 10 is spaced longitudinally from the head stabilizer 12 by about 15 mm and is spaced longitudinally from the cylindrical section 8 by about 20 mm.

The damper 3 may be made in part or in whole from rubber or polyurethane (PU) having uniform density throughout the portions of the damper 3. Also, the material forming the damper 3 may be made in part or in whole from at least one of Poron®, armourgel, D30®, or some other suitable material. The damper 3 may be constructed as a unitary member or as an assembly of one or more of the outer anchor 8, outer neck 14, shaft 9, pendulum mass 10, a resilient member 11, and head stabilizer 12. In one embodiment, each of the aforementioned sections of the pendulum damper 3 may have the same or different compressibility or stiffness, where stiffness has an inverse proportional relationship to compressibility. In one embodiment, the outer anchor 8 and the shaft 9 may have the greatest stiffness, whereas the pendulum mass 10, resilient member 11, and head stabilizer may be constructed having relatively less stiffness. In accordance with the teachings of the present disclosure, the material employed and the values selected for compressibility or stiffness for each section of the damper 3 allows the damper 3 to carry out its desired effect in absorbing angular acceleration and deceleration during a glancing oblique impact or translational impact.

Figure 7A:
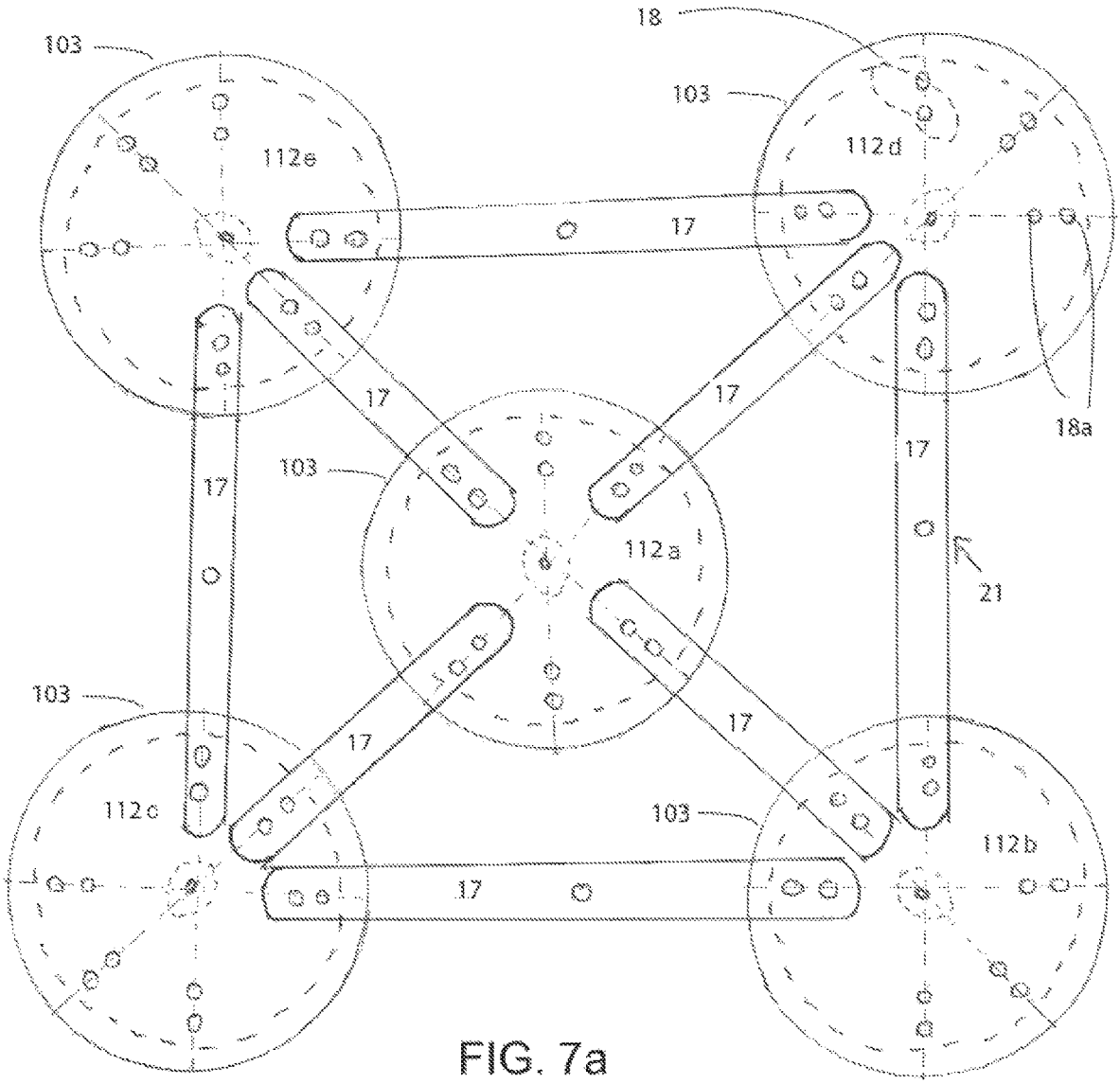
FIG. 7*a* is an illustration of an embodiment of a system that employs a plurality of dampers and straps.

FIG. 7*a* shows a plan view of an example arrangement in which a plurality of dampers 103 are arranged in a mounting pattern of a helmet, such as helmet 1. In the example of FIG. 7*a*, a helmet is not shown for clarity of illustration. The dampers 103 are the same as dampers 3, but with the exception that the head stabilizer 112, which is modified from head stabilizer 12, defines a plurality of sets 18 of holes 18*a*, the function of which will be described in greater detail below. The holes 18*a* of each set 18 are radially spaced from each other. Also, each set 18 is equally spaced circumferentially from an adjacent set 18. In the embodiment shown in FIG. 7*a*, adjacent sets 18 of holes 18*a* are spaced about 45 degrees apart.

The dampers 103 are connected by a plurality of flexible links 17. In this example, five dampers 103 are shown mounted at different locations in the mounting pattern. The dampers 103 are arranged so that one central stabilizer 112*a* is positioned in the helmet to contact the crown of the head, two head stabilizers 112*b*, 112*c* are positioned to contact the right and left front of the head, and two head stabilizers 112*d*, 112*e* are positioned to contact the right and left back of the head. As shown in 7*a*, four of the head stabilizers 112*b*, 112*c*, 112*d*, and 112*e* are arranged in a square pattern around the central stabilizer 112*a*.

Figure 7B:
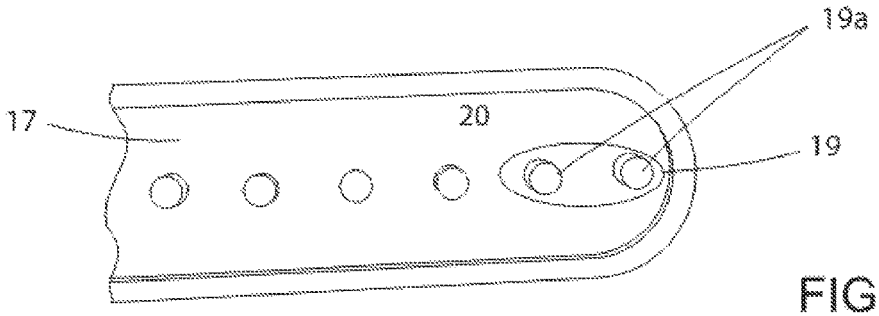
FIG. 7*b* illustrates a portion of a strap shown in FIG. 7*a*.

The five head stabilizers 112*a* to 112*e* are connected together by the flexible links (e.g., bands or straps) 17, one of which is shown in greater detail in FIG. 7*b*. Specifically, the four stabilizers 112*b* to 112*e*, which surround the central stabilizer 112*a*, are connected by links 17 in a square pattern, and those four stabilizers 112*b* to 112*e* are each connected to the central stabilizer by other links 17 in an x-pattern. The flexible links 17 facilitate positioning each respective pendulum mass 110 of each damper 103 within a corresponding hole (e.g., hole 4 in helmet 1) and thereby correctly position each head stabilizer 112*a* to 112*e* with respect to the head. Each link 17 is connected, at its ends, to a pair of the stabilizers 112.

As shown in greater detail in FIG. 7*b*, each link 17 has a plurality of sets 19 of protrusions 19*a* that extend inwardly from an inward facing side 20 of the link 17. Each set 19 of protrusions 19*a* is configured to be received in a corresponding set 18 of holes 18*a* in the link 17. In one embodiment, the links 17 are formed from flexible plastic and may be constructed like the snap back straps of a baseball cap. Each link 17 also has a through hole 21 (FIG. 7*a*) at its center between the ends of the link 17. The head stabilizers 112*a* to 112*e* may be coupled to a retention system (not shown) through links 17 to further attach the helmet to the head or to the chin of the user. For example, in one embodiment, a chinstrap, such as that shown in FIG. 12, may be connected to holes 21 in links 17, which are connected to the head stabilizers 112*a* to 112*e*.

Owing to differences in sizes of helmets to fit different sizes of heads, the spacing between the head stabilizers 112 can vary. Therefore, to accommodate such variability in sizing, the links 17 may be fabricated so that their lengths may be sized based on the size of the helmet to which the links 17 are coupled. In one embodiment, for example, the links 17 may be made of a continuous strip of material having regularly spaced sets 19 of protrusions extending therefrom, such that the material may be cut to lengths based on the spacing of the head stabilizers 112 for the respective helmet size. Alternatively, in another embodiment, the links 17 may be configured to be adjustable without being cut, such as, for example, by being made as a two-piece assembly with one piece having a series of sets 19 of protrusions 19*a* and another mating piece with a series of sets 18 of through holes 18*a* that can receive the protrusions 19*a*, similar to the aforementioned two-piece adjustable, snap-back baseball hat straps.

In the event of an impact against the helmet 1, there will be relative motion between the damper 3 and the helmet 1 described above, such that the damper 3 will deflect from the neutral position shown in FIG. 6*a*. In the case of a glancing oblique impact on the helmet 1, such as that shown in FIG. 2, the impact can be viewed as a two-stage event: a first spin-up stage; and a second spin-down stage following the first spin-up stage.

FIG. 8*a* shows a state of the damper 3 of FIG. 6*a* upon being deflected from its neutral position during the first spin-up stage. When the helmet 1 experiences a glancing oblique impact, the helmet 1 experiences an angular acceleration (termed "spin-up") due to an external torque applied to the outer shell 5 of the helmet 1. The external torque is represented by the arrow pointing leftward in FIG. 8*a*. In response to the applied external torque, there is an inertia response of the damper 3 to counter the applied torque, the response represented by the arrow pointing rightward in FIG. 8*a*. In that regard, the loosely hanging pendulum mass 10 remains in the same state of motion (rest), while the outer shell 5, liner 6, and comfort liner 7 move leftward, thereby causing bending/flexing/shearing of the shaft 9 at the narrow neck 14 and similarly at the resilient member 11, as well as between the shaft 9 and the pendulum mass 10 and between the pendulum mass 10 and the resilient member 11. If the torque is sufficiently large, the pendulum mass 10 may contact the inner surface of the liner 6 surrounding the second portion 4*b* of the hole 4, as shown in FIG. 8*a*. The inertial effect of the damper 3 will result in the head stabilizer 12 engaging the head 2 so that the head 2 remains in the at rest in the helmet 1, thereby reducing angular acceleration effects to the brain. FIG. 8*b* shows an exploded view of the top portion of the helmet 1 shown in FIG. 8*a*, showing the vent holes 13 and flexure of neck 14.

Following the spin-up stage, the "spin-down" stage commences, during which the helmet 1 will undergo angular (rotational) deceleration and where the helmet 1 experiences a torque (represented by arrow pointing rightward in FIG. 9*a*) in a direction opposite that during the spin-up stage. The outer shell 5, liner 6, and comfort liner 7 move rightward, thereby causing bending/flexing/shearing of the shaft 9 at the narrow neck 14 and similarly at the resilient member 11, as well as between the shaft 9 and the pendulum mass 10 and between the pendulum mass 10 and the resilient member 11. During the spin-down stage, the mass 10 moves to a side of the axis A-A opposite to that during the spin-up stage. The inertial response of the damper 3, and more particularly the pendulum mass 10, will cause the head stabilizer 12 to engage the head 2 so as to remain at rest inside the helmet 1, thereby reducing angular deceleration effects to the brain. FIG. 9*b* shows an exploded view of the top portion of the helmet 1 shown in FIG. 9*a*, showing the vent holes 13. After the spin down stage the pendulum mass 10 will return to its neutral position along axis A-A, shown in FIG. 6*a*, such that the pendulum mass will have completed one full oscillation about axis A-A after experiencing a glancing impact.

The helmet 1 may also experience external forces that are not purely glancing impacts. For example, the helmet 1 may also experience external forces that have a component that resolves to be directed in the longitudinal direction. As described above, at least the resilient member 11 of the damper 3 is compressible and extendable in the longitudinal direction so that if the helmet experiences an external force in the longitudinal direction, the relative movement between the outer shell 5 and the comfort liner 7 may cause the damper 3 to compress like a spring to absorb some of the impact force along with the foam liner 6.

Figure 10A:
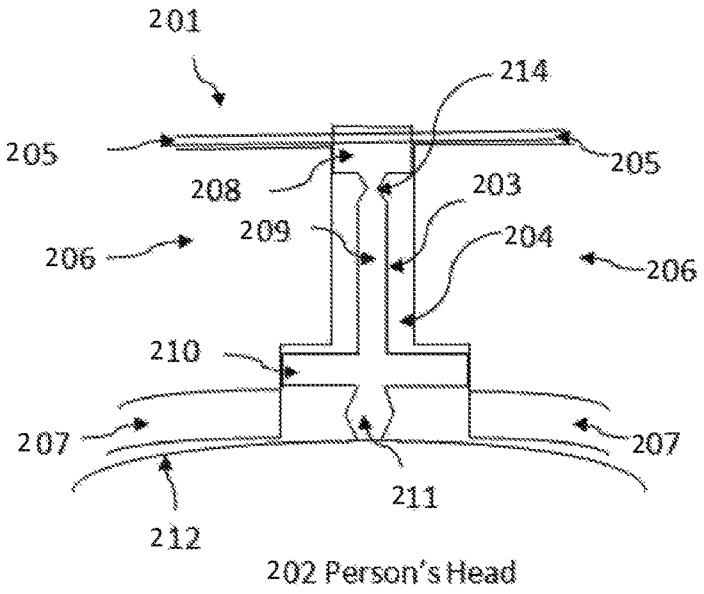
FIG. 10*a* is a schematic cross-sectional view of a second embodiment of a pendulum damping system in accordance with the present disclosure.

FIG. 10*a* shows a cross-section view of another embodiment of a pendulum impact damper 203, similar in construction to damper 3, but where like elements are incremented by "200". The resilient member 211 is configured to flex, bend, and shear. The main difference between damper 203 and damper 3 is that the diameter of pendulum mass 210 of damper 203 is larger than mass 10 so that in the neutral position shown in FIG. 10*a*, the mass 210 is in contact with the inside surface of a second portion 204*a* of damping hole 204. The mass 210 may be formed of a compressible material, such as rubber. In view of the mass 210 contacting the inside surface of the second portion 204*a* in the neutral position, the mass 210 may swing less about the neck 214 than the mass 10 does about neck 14 in damper 3. Instead, during a glancing oblique impact event, such as described above with respect to FIGS. 8*a* to 9*b*, the shaft 209 will angularly deflect with respect to axis A-A and the mass 210 will tend to compress laterally against foam liner 205, which will act to absorb energy. The material properties of the mass 210 may be selected to achieve desired inertia responses during the spin-up and spin-down stages. For example, to achieve a longer spin-up time, a more compressible material may be selected for the mass 210 and to achieve a shorter spin-up time, a less compressible material may be selected for the mass 210.

Figure 10B:
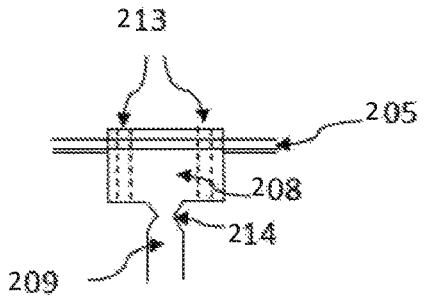
FIG. 10*b* is an exploded schematic cross-section of a top portion of the pendulum impact damping system shown in FIG. 10*a*.

FIG. 10*b* shows an exploded view of a top portion of the cross section of FIG. 10*a*, incorporating, optionally, two vertical cylindrical air vents 213 on opposite sides of the cylindrical top section 208. The air vents 213 may be formed as cylindrical through holes. The cylindrical air vents 213 are used to convey air between the exterior of the helmet and the interior of the helmet via the damping hole 204.

Figure 11A:
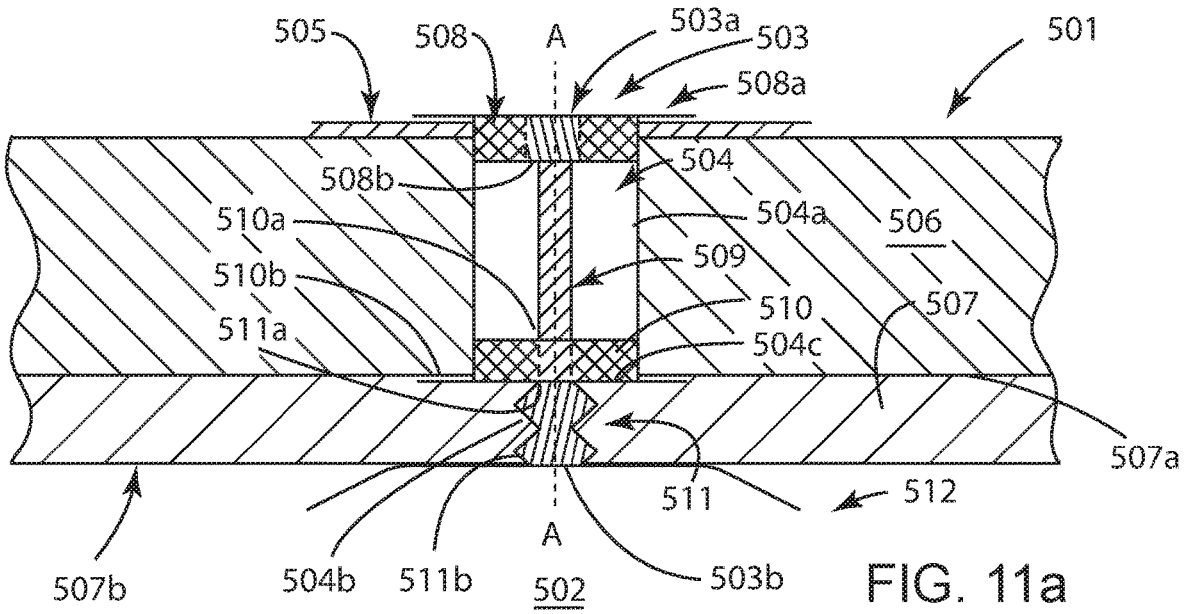
FIG. 11*a* is a schematic cross-sectional view of a third embodiment of a damping system in accordance with the present disclosure.

FIG. 11*a* shows a cross-section of yet another embodiment of a pendulum impact damper 503, that is positioned at least partially inside a circular damping hole 504 defined through the thickness of a helmet 501. The hole 504 extends longitudinally from the outside of the helmet 501 to the inside of the helmet 501.

The helmet 501 includes a hard outer shell 505 and a shock absorbing liner 506, which extends against an inner contact surface of the outer shell 505. The shock absorbing liner 506 may be made of foam, such as expanded polystyrene foam (EPS), for example. Alternatively the shock absorbing liner 506 may be made of a viscoelastic material. An outer end 503*a* of the damper 503 may be connected to the outer shell 505. The helmet 501 also includes a comfort liner 507 that extends against an inner contact surface of the shock absorbing liner 506. The comfort liner 507 is spaced from a head stabilizer 512, which is connected to an inner end 503*b* of the damper 503. While the embodiment shown in FIG. 11*a* shows the resilient member 511 directly in contact with the comfort liner 507, the resilient member 511 may also be laterally spaced from the comfort liner 507 and be located in a bore hole 504*b* that is slightly larger than the lateral extent of the resilient member 511.

Figure 11B:
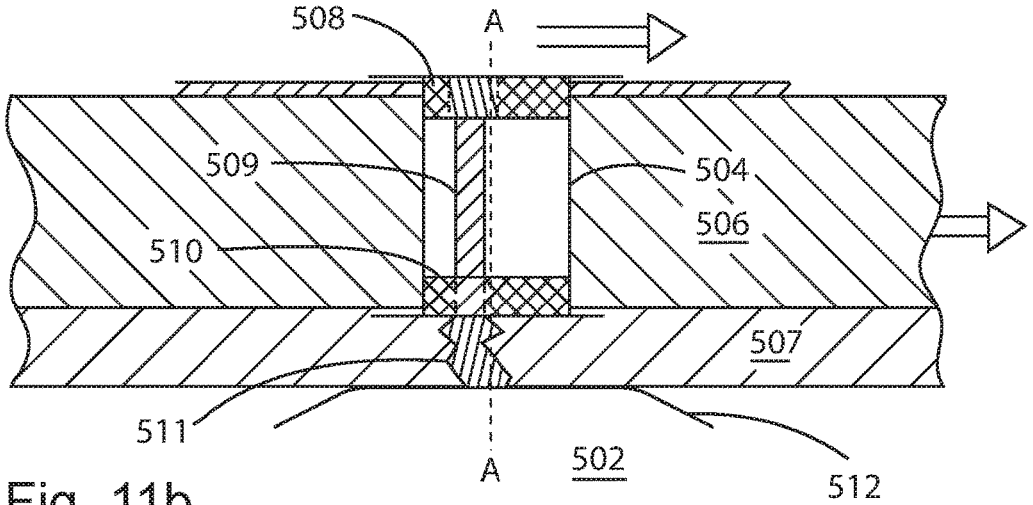
FIG. 11*b* is a schematic cross-sectional view of the damping system of FIG. 11*a* showing its response during a first stage (acceleration "spin up") caused by a glancing oblique impact.

The longitudinally-extending hole 504 is defined by two portions, a first portion 504*a* and a second portion 504*b*, which may have the same or different diameters, as shown in FIGS. 11*a* and 11*b*. In FIG. 11*a*, the first portion 504*a* extends inwardly from the outer side of the hard outer shell 505 to a transition point 504*c* located at an interface between the shock absorbing liner 506 and the comfort liner 507. A second portion 504*b* extends from the transition point 504*c* through the comfort liner to an inner side 507*a* of the comfort liner 507. The transition point 504*c* is a point where the diameters of the two portions 504*a* and 504*b* of the hole 504 vary. In that regard, the second portion 504*b* has a smaller diameter than the first diameter 504*a*.

The damping system 503 may be conceptually divided into sections: 1) an outer disc 508, 2) a shaft 509, 3) an inner disc 510, 4) a resilient member 511, and 5) a head stabilizer 512.

The outer disc 508 is attached (e.g., adhered, fused, bonded, etc.) to the outer shell 505 of the helmet 501. As shown in FIG. 11*a*, a lip or flange 508*a* may extend from around the outer disc 508 that engages the outer surface of the outer shell 505. The outer disc 508 is made from a compressible material, such as rubber. The outer disc 508 has a diameter that is substantially the same as that of the first portion 504*a* of the damping hole 504 such that the outer disc 508 is partly embedded in the damping hole 504. The outer disc 508 may be attached to the outer shell 505 and/or the foam liner 506. The outer disc 508 has a hole 508*b* formed longitudinally in the center of the outer disc 508. The central hole 508*b* receives therein and secures an upper end 509*a* of the shaft 509. In at least one embodiment, the entire damping system 503 may be formed as one unitary piece, rather than as an assembly.

The shaft 509 extends inwardly from the outer disc 508 to an inner end 509*b*, which is received in and secured to a central opening 510*a* formed in the inner disc 510. The shaft 509 may be a rigid rod that may be made from hard rubber. The shaft 509 is spaced from and has no contact with an inner surface of the hole 504. In a neutral, undeformed position shown in FIG. 11*a*, the outer disc 508, the shaft 509, and the inner disc 510 extend coaxially along the longitudinal axis A-A.

A lip or flange 510*b* may extend from around the inner disc 510 and may engage an inner surface of the foam liner 506. The inner disc 510 may be made from a compressible material, such as rubber. The inner disc 510 has a diameter that is substantially the same as that of the first portion 504*a* of the damping hole 504 such that the outer disc 510 is in contact with the inner surface of the damping hole 504. The inner disc 510 may be attached to the foam liner 506.

The resilient member 511 extends through the second portion 504*b* of the damping hole 504. The inner end 509*b* of the rod 509 may be connected to an outer end 511*a* of the resilient member 511. The resilient member 511 is configured to compress longitudinally and to pivot with respect to the longitudinal axis A-A. The resilient member 511 may be formed from at least one of rubber, Poron®, armourgel, D30®, or other suitable compressible material. In at least one embodiment, 508, 509, 510, 511 and 512 may be formed together as a unitary piece from one of PU, rubber, Poron®, armourgel, D30®, or other suitable compressible material.

A head stabilizer 512 is connected to an inner end 511*b* of the resilient member 511. The head stabilizer 512 is spaced from an inner surface 507*b* of the comfort liner 507. An inner surface of the head stabilizer 512 is configured to contact or otherwise engage the head 502 at or near a predetermined position on the head 502. In one embodiment, the helmet 501 may include a plurality of dampers 503 arranged in a pattern in the helmet 501, such as the pattern shown in FIG. 7*a*.

FIG. 11*b* illustrates the positioning of the damper 503 after a spin-up stage of a glancing impact. As shown in FIG. 11*b*, a glancing oblique impact imparts a torque, noted by the arrow to the right that moves the elements of the helmet 501, other than the rod 509, to the right. The rod 509 remains at rest and coupled to the head 502 via the head stabilizer 512. As a result of the relative motion and the engagement of the head stabilizer 512 with the head 502, the outer and inner discs 508 and 510 are compressed laterally inside hole 504 by the rigid rod 509, while the resilient member 511 experiences at least one of bending/flexing/shearing relative to the longitudinal axis A-A. The energy absorbed by the compressible discs 508 and 510 and the resilient member 511 reduces the torque transferred to the head 502.

Figure 11C:
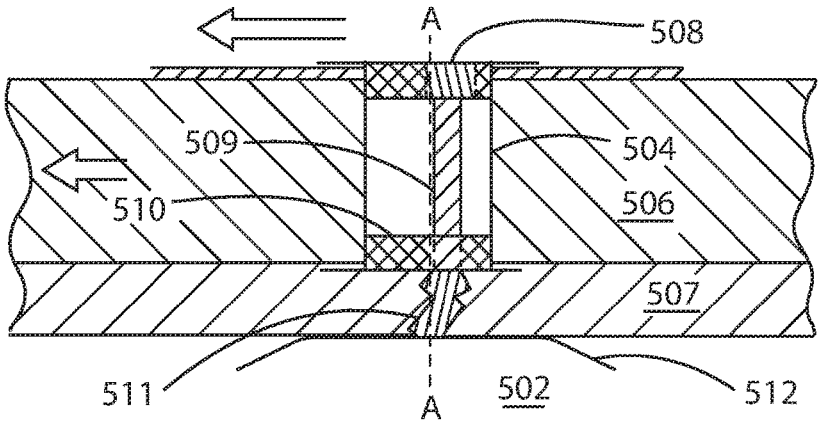
FIG. 11*c* is a schematic cross-sectional view of the damping system of FIG. 11*a* showing its response during a second stage (acceleration "spin down").

FIG. 11*c* illustrates the positioning of the damper 503 after a spin-down stage of a glancing impact. During the "spin-down" stage the helmet 501 undergoes angular (rotational) deceleration and experiences a torque, noted by the arrow pointing leftward in FIG. 11*c*. (i.e., in a direction opposite that during the spin-up stage). The outer shell 505, liner 506, and comfort liner 507 move leftward, while the rod 509 remains at rest and coupled to the head 502 via the head stabilizer 512. As a result of the relative motion and engagement of the head stabilizer 512 with the head 502, the outer and inner discs 508 and 510 are compressed laterally inside hole 504 by the rigid rod 509, while the resilient member 511 experiences at least one of bending/flexing/shearing relative to the longitudinal axis A-A. Thus, during the spin-down stage, the rod 509 moves to a side of the axis A-A opposite to that during the spin-up stage. The energy absorbed by the compressible discs 508 and 510 and the resilient member 511 reduces the torque transferred to the head 502.

After the spin down stage the discs 508 and 510 will resiliently expand and the rod 509 will return to its neutral position along axis A-A, shown in FIG. 11*a*, such that the rod 509 will have completed one full oscillation about axis A-A after experiencing a glancing impact.

The rod 509 may be longitudinally compressible instead of being relatively rigid, so that both the rod 509 and the resilient member 511 may deflect in the longitudinal direction. The switch to a compressible material for the rod 509 may provide added energy absorption by the damping system 503, such as during longitudinal impacts, for example. The resilient member 511 should also provide energy absorption during longitudinal/translational impacts.

Figure 12:
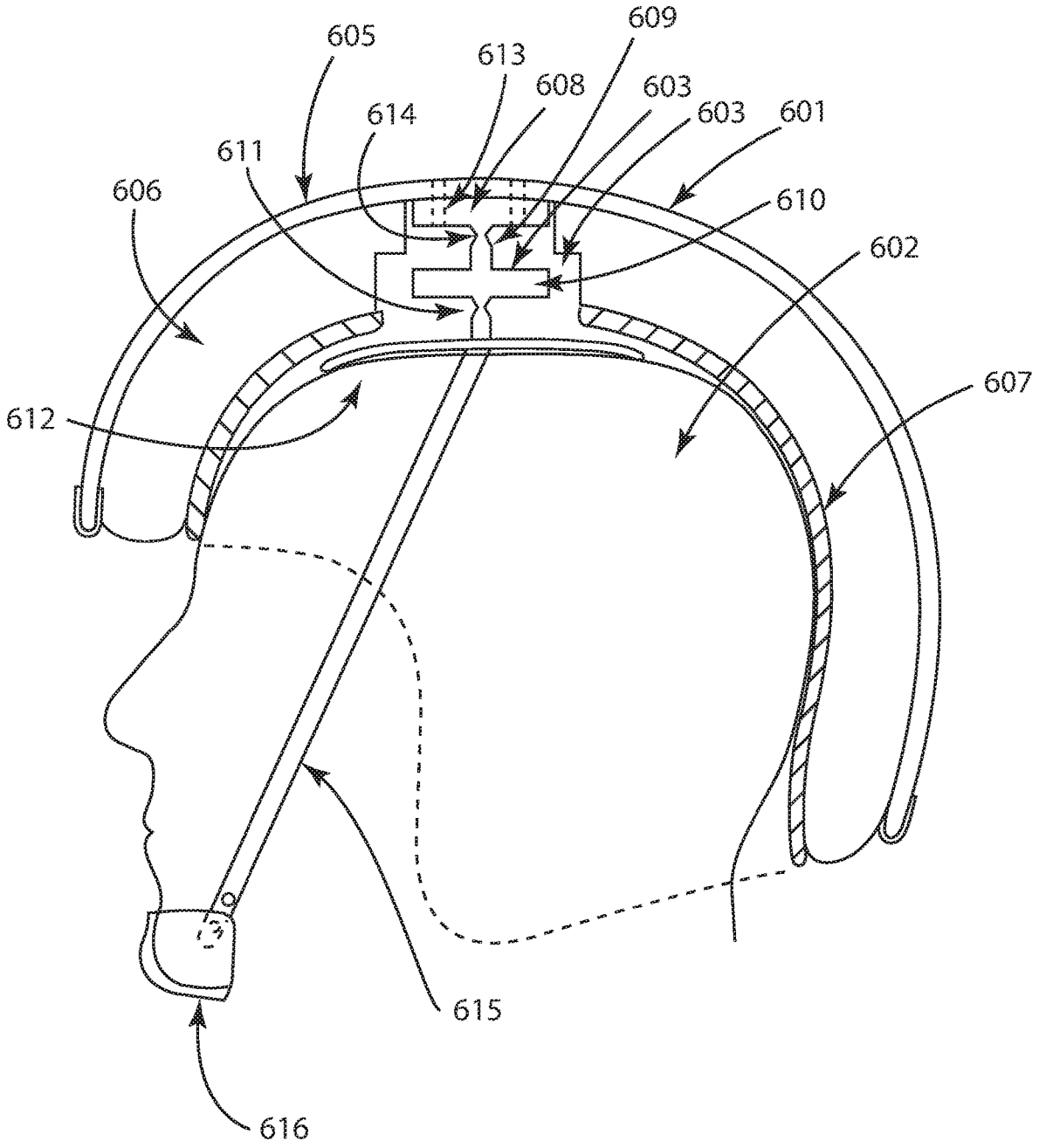
FIG. 12 is a side section view of an embodiment of a helmet that includes another embodiment of a restraint system.

FIG. 12 illustrates another embodiment of a helmet 601 worn on the head 602 of a wearer. The helmet 601 is generally constructed in the same manner as the helmet 1 in the FIGS. 6*a* to 6*d*, but differs in the damper 603 that is mounted in the helmet 601. The damper 603 shares the same construction as damper 3 and like elements are incremented by "600". Specifically, the damper 603 includes an outer anchor 608, an outer neck 614, shaft 609, pendulum mass 610, resilient member 611, head stabilizer 612 and air vents 613 as shown. However, the damper 603 has larger dimensions than damper 3 such that it may be used alone in the helmet 601, instead of as one of a plurality of dampers arranged such as that shown in FIG. 7*a*. Specifically, such a larger damper 3 may be located at the crown of the helmet as an alternative to using a plurality of elements in a helmet as shown in FIG. 7*a*. The damper 603 has a head stabilizer 612,which is attached to a chinstrap 615 and chin pad 616 that can be wrapped about the user's chin to retain the helmet 601 on the head 602 and facilitate positioning the damper 603 with respect to the head 602. The head stabilizer 612 is relatively larger than head stabilizer 12 of damper 3 and may be formed as a skullcap. The skullcap may extend to the top of the forehead (hair-line) and above the ears. The chinstrap 615 may be elastic to facilitate positioning the chin pad 616 under the user's chin. While the chinstrap 615 may be used to position the helmet 601 with respect to the head 602, the chinstrap 615 may be a secondary chinstrap used in conjunction with a primary chinstrap, not shown, for more firmly securing the helmet 601 to the head 602. Such a primary chinstrap may be adhered to both sides (e.g., under the ears of the head 602) of the inner surface of the outer shell 601.

There have been described and illustrated herein several embodiments of a pendulum impact damping system. While particular embodiments of the invention have been described, it is not intended that the invention be limited thereto, as it is intended that the invention be as broad in scope as the art will allow and that the specification be read likewise. Thus, while particular materials and configurations have been disclosed, it will be appreciated that other materials and configurations may be used as well. It will therefore be appreciated by those skilled in the art that yet other modifications could be made to the provided invention without deviating from its spirit and scope as claimed.

What is claimed is:

1. A helmet comprised of:

an outer shell;

a compressible liner in contact with an inner surface of the outer shell;

a comfort liner in contact with an inner surface of the compressible liner, where at least one damper hole is defined at least through the compressible liner, each at least one damper hole extending and centered about a longitudinal axis that extends radially through the outer shell, the compressible liner, and the comfort liner; and at least one energy damper disposed in a corresponding damper hole of the at least one damper hole, the at least one energy damper extending coaxially with the longitudinal axis, and the at least one energy damper including a compressible inner disc spaced inwardly from the outer shell, the compressible inner disc engaged with the compressible liner and being laterally compressible;

a head stabilizer flexibly coupled to the compressible inner disc and spaced inwardly from the compressible inner disc, wherein the head stabilizer is configured to engage a head of a wearer of the helmet;

a compressible outer disc engaged with the outer shell; and a rod extending from the compressible outer disc to the compressible inner disc;

wherein in response to an oblique force in a first direction applied externally to the outer shell, the outer shell, the compressible liner, the comfort liner and the corresponding damper hole are configured to be displaced laterally together in the first direction without relative lateral displacement therebetween, while the compressible inner disc is compressed in a second direction opposite the first direction and the head stabilizer remains stationary.

2. The helmet of claim 1, wherein:

the rod is compressible or rigid.

3. The helmet of claim 1, wherein: the compressible outer disc and the compressible inner disc are attached to an inner surface of the corresponding damper hole.

4. The helmet of claim 1, further comprising: a resilient member extending between and coupling the compressible inner disc and the head stabilizer, wherein the resilient member is embedded in a space within the comfort liner.

5. The helmet of claim 4, wherein:

the resilient member has a neutral position in which it is longitudinally and laterally aligned with the longitudinal axis and is longitudinally compressible from the neutral position to decrease a length of the resilient member along the longitudinal axis, longitudinally extendable to increase a length of the resilient member along the longitudinal axis, and flexible about the longitudinal axis to laterally displace ends of the resilient member relative to one another.

6. The helmet of claim 1, wherein:

the at least one energy damper is formed from at least one of rubber, polyurethane, urethane foam, dilatant non-Newtonian fluid, and viscoelastic, non-Newtonian silicone.

7. The helmet of claim 1, wherein:

the rod, the compressible the inner disc, and the compressible outer disc are coaxially aligned.

8. The helmet of claim 1, wherein: in a rest state the compressible inner disc is coaxially aligned with the corresponding damper hole and is uncompressed in the corresponding damper hole.

9. The helmet of claim 1, wherein: the at least one energy damper comprises a plurality of energy dampers disposed in corresponding ones of a plurality of damper holes of the at least one damper hole; and a plurality of flexible straps connecting the plurality of energy dampers together.

10. The helmet of claim 9, further comprising: a plurality of head stabilizers, and each one of the plurality of flexible straps is configured to connect to corresponding ones of the plurality of head stabilizers.

11. The helmet of claim 1, wherein:

in response to said oblique force, the rod is displaced laterally in the second direction and the compressible inner and outer discs are compressed laterally in the second direction.

12. The helmet of claim 1, wherein:

in response to said oblique force, compression of the compressible inner disc oscillates laterally in the corresponding damper hole to facilitate dissipation of energy of the impact.

13. The helmet of claim 1, wherein: in a rest state the compressible outer disc is coaxially aligned with the corresponding damper hole.

* * * * *